United States Patent [19]

Petters

[11] 4,281,427

[45] Aug. 4, 1981

[54] WARNING AND SIGNALLING DEVICE, ESPECIALLY FOR MARITIME PURPOSES

[75] Inventor: Claus Petters, Hamburg, Fed. Rep. of Germany

[73] Assignee: Messerschmitt-Bolkow-Blohm GmbH, Munich, Fed. Rep. of Germany

[21] Appl. No.: 95,991

[22] Filed: Nov. 20, 1979

[30] Foreign Application Priority Data

Nov. 29, 1978 [DE] Fed. Rep. of Germany ..... 2851588

[51] Int. Cl.[3] ..... B63B 21/52

[52] U.S. Cl. ..... 9/9; 116/210

[58] Field of Search ..... 9/8 R, 9; 116/209, 210; 244/153 R, 155 R, 31, 32, 138 R, 139, 140

[56] References Cited

U.S. PATENT DOCUMENTS

| | | | |
|---|---|---|---|
| 1,202,315 | 8/1970 | Schermuly | 116/210 |
| 2,208,786 | 7/1940 | Astle | 244/153 R |
| 2,923,917 | 2/1960 | McPherson et al. | 116/210 |
| 3,930,448 | 1/1976 | Barber et al. | 116/210 |
| 4,102,296 | 7/1978 | Felix | 9/9 |
| 4,120,259 | 10/1978 | Wilson | 116/210 |

*Primary Examiner*—Trygve M. Blix
*Assistant Examiner*—Jesús D. Sotelo
*Attorney, Agent, or Firm*—W. G. Fasse; D. F. Gould

[57] ABSTRACT

The present warning and/or signalling device is intended to provide radar signal reflections for locating a ship or an aircraft wreck or reflected warning signals when sensing the approach of a vessel, such as a submarine. For this purpose a radar reflector forms a unit with a first buoyancy or lift structure. The unit in turn is stored in a second buoyancy or lift structure which may be placed below or above sea level. The second buoyancy or lift structure is further equipped with identification and/or other types of sensors.

10 Claims, 3 Drawing Figures

WARNING AND SIGNALLING DEVICE, ESPECIALLY FOR MARITIME PURPOSES

BACKGROUND OF THE INVENTION

The present invention relates to a warning and signalling device, especially for maritime purposes. Such a device is equipped with a radar reflector.

German Pat. No. 817,259 disclosed a rescue apparatus for locating missing aircraft or ships. This known rescue apparatus comprises a gas filled, red balloon and a steel wire cable which rigidly secures the balloon to the ship wreck or aircraft. This apparatus or arrangement cannot be located by means of radar over larger distances. If the wrecked ship or aircraft should sink, the balloon is pulled down to the ocean surface or even under the water surface because the steel wire cable rigidly connects the balloon to the ship or aircraft. Thus, a signalling effect is not achieved anymore or at least such effect is very limited.

German Patent Publication No. 1,119,707 discloses an inflatable life raft provided with means for the reflection of radar radiation, whereby the locating reflector is foldable so that upon inflation of the life raft the locating reflector is also erected. However, this apparatus is effective for radar locating devices only for very short distances which are within the visible range due to the location of the apparatus directly on the water surface. In rough seas this limited effective range is even further limited so that the advantageous radar locating is hardly usable.

OBJECTS OF THE INVENTION

In view of the above it is the aim of the invention to achieve the following objects singly or in combination:

- to provide a warning and signalling apparatus which makes possible a radar locating operation over long distances;
- to provide a radar locating target which is suitable for signalling the occurrence of an accident such as a ship or aircraft wreck and which also may be used for military defense purposes;
- to construct a radar locating target which is capable of a completely independent operation;
- to provide a system for an early warning of the presence of vessels such as enemy submarines; and
- to construct the signalling and warning device in such a manner that it will be effective even under storm conditions.

SUMMARY OF THE INVENTION

The invention achieves the above objectives by a warning and signalling device which comprises a radar reflector operatively combined with a buoyancy and lift means such as a balloon. Second buoyancy or lift means are constructed for storing the functional unit. The second buoyancy or lift means such as a buoy comprises sensor means operatively arranged for controlling the operation thereof. The second buoyancy or lift means also are equipped with supply means such as a gas generator for inflating the first buoyancy or lift means, and with a power source.

The first buoyancy means may be combined with a third buoyancy means whereby the latter is constructed as a so-called storm kite.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
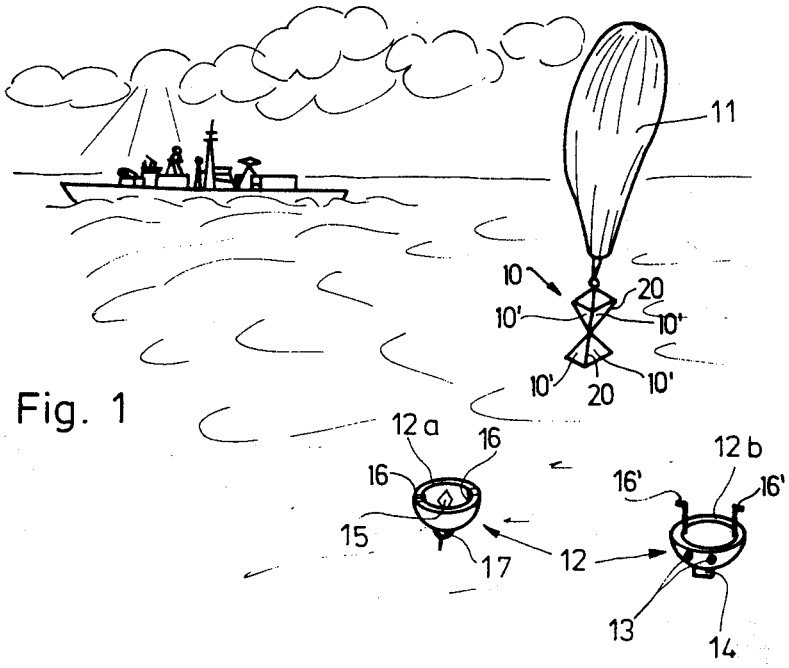
FIG. 1 is a perspective view of a somewhat schematic illustration of an apparatus according to the invention shown at an instant immediately after contacting the water surface.

FIG. 1 shows an example embodiment of the invention comprising a radar reflector 10 including a plurality of surface elements 10' interconnected with each other along pleats 20 to permit a folding of the radar reflector 10 prior to the inflating and ascending of a balloon 11. The surface elements 10' are so located that radar radiation will be reflected regardless from which direction it impinges upon the radar reflector 10.

The buoyancy and/or lift producing element or balloon 11 constitutes a first buoyancy or lift means which forms together with the radar reflector 10 an operational unit. However, such operational unit may also be provided by constructing, for example, the surface of the balloon 11 as a radar reflecting surface. For example, by lining the balloon surface with aluminum foil. Incidentally, the surfaces 10' may also be covered with aluminum foil.

According to the invention the functional unit 10, 11 is initially located in a second buoyancy and/or lift means 12 in the form of a buoy having a lower half shell **12*a* and an upper half shell 12*b*. For example, the lower half shell may be provided with interlocking grooves or cut-outs 16 which cooperate with locking hooks 16' in the upper shell 12*b*. Further, the buoy 12 is equipped with sensors 13 and 14. For example, the sensor means 13 may be equipped with sonar sensor members 13'. The second sensor means 14 may be equipped with light sensors 14'**. The type of sensor means will depend on the particular mission to be accomplished by the system.

The example embodiment shown in FIG. 1 may, for instance, be used as an early warning system for enemy submarines. Depending on the tactical location and characteristic features of the particular sea zone, a plurality of the present system components is distributed in the particular zone at predetermined spacings one from the other. The buoy 12 is equipped, for example, in its lower shell with anchoring means 17 to secure the buoy 12 to the ocean floor at a predetermined depth. The anchoring means may be constructed for the direct anchoring at the ocean floor or it may comprise anchoring ropes or wires for locating the buoy at a certain depth below the water surface. The buoy 12 is also equipped with supply means such as a gas generator 15 for inflating the balloon 11. The supply means may also comprise power generator or battery means for the energizing of any electronic switching means and the like. Preferably, the supply means including the gas generator and an electrical power supply means are operatively arranged inside the lower half shell **12*a***.

The upper half shell 12*b* may be constructed as a cover and preferably carries the above mentioned sensors 13 and 14 with the sensing elements proper 13', 14'. As mentioned, the sensor 13 may be constructed to pick up typical submarine signals. On the other hand, the sensors 14, 14' may respond, for example, to the buoy 12 penetrating through the water surface. Thus, the sensor 14' could be a light sensor or it could be a pressure responsive sensor or the like. The sensors 13, 13' and 14, 14' are well known as such.

In operation, when the sensors 13 register the approach of a submarine, a switching impulse will be produced which releases the entire buoy 12 from its anchoring 17. This may be accomplished by conventional anchoring means, for example, including an electrically operated magnet or mechanical means operated by a solenoid or the like. Substantially simultaneously the sensor 14 is activated which releases the locking means 16, 16' immediately upon the penetration of the water surface by the buoy 12, whereby the upper and lower half shells are separated from each other for example, by the release of a spring force or by a controlled explosion. Simultaneously the sensor 14 activates the gas generator 15 for filling the balloon 11 with a gas and for energizing marker means. Such marker means may be of the optical kind, they may include an electronic beacon, or acoustical and/or thermal marking components may be involved. An optical marker could be a simple blinker light or the like.

Due to the inflating of the balloon 11 the latter is pulled out of the now opened buoy, preferably, the lower half shell 12*a* and the removal simultaneously unfolds the radar reflector 10. When the lift or buoyancy of the balloon 11 exceeds a certain value, the balloon 11 is released from the gas generator 15 and ascends. The ascending balloon or rather its radar reflector is picked up by the monitoring radar system on board a ship or in a land based radar station which then may initate the required defense or other measures.

With regard to the anchoring of the buoy 12 on the ocean floor it is, for example, possible that the buoy 12 remains connected with the ocean floor through its anchoring device 17 and through a pay-out rope or cable when the buoy rises toward the water surface. Similarly, upon separation of the two shells 12*a*, 12*b* of the buoy when the interlocking elements 16, 16' are released, it is possible to keep the two half shells connected to each other, for example, through an elastic connecting means such as a rubber cable or the like.

According to a modification it is possible to store one or several buoys 12 in a container at the location of their use. Upon opening the container or other release, the buoy 12 will leave the container and travel to the water surface. The buoys 12 will, preferably, be made of a material lighter than water. If one or several buoys 12 are stored in a container, it is possible to install the sensor 13, 13' in the container rather than in the buoy.

Figure 2:
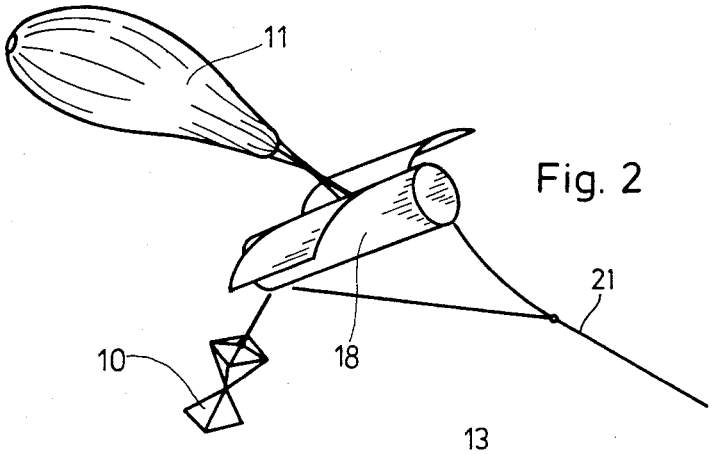
FIG. 2 is also a perspective view of a modified embodiment of the invention.

According to a further modification it is intended to maintain a connection between the operational unit 10, 11 and the buoy 12, for example, by means of a rope 21 shown in FIG. 2.

FIG. 2 shows a still further modification of the invention in which the first buoyancy and/or lift means such as the balloon 11 forms a structural unit with the radar reflector 10 and a still further buoyancy or lift element 18, whereby the latter is constructed as a so-called storm kite which is connected with the rope or cable 21 to the ground or to the above mentioned second buoy type buoyancy or lift element 12. The embodiment of FIG. 2 is especially suitable for use on ships and is therefore carried on ships as part of their distress equipment. In case of an emergency, this warning and signalling device is activated. The signal device may be secured to the vessel itself or it may be anchored to the ocean floor at the point of the accident. The device may also be ejected by a submerged submarine. Due to the construction of the buoyancy and/or lift element 18 as a storm kite, it is possible to operate the device even under heavy storm conditions because of sufficient flying capability of the storm kite is assured.

The advantage of the apparatus of the invention and especially of that of FIG. 2 is seen in that it comprises substantially all passive, functional elements requiring substantially no maintenance. Merely with regard to the supply unit certain limitations with regard to the operational life may have to be taken into account especially with regard to the type of gas supply used and with regard to the type of use for which the equipment is intended.

Another advantage of the invention is seen in that by placing the radar reflector at a sufficient height above sea level the probability of a successful search for a vessel or aircraft in distress is substantially assured because the searching can now be enhanced by the use of radar equipment. Thus, the known features of the radar, especially as far as its range and its precision is concerned, guarantee a quick locating of the object in distress or the like.

The lift element balloon 11 may also support an electronic beacon or radio transmitter adjacent to the radar reflector 10. For example, as shown in FIG. 2, the element 18 may alternatively be viewed as an electronic beacon or radio transmitter.

It is also contemplated according to the invention that the buoy 12 may be constructed as a rocket with an adjustable flight ceiling. Upon reaching this flight ceiling or level the radar reflector and its lift balloon 11 are ejected. In a modification the balloon may be replaced by a parachute. In this connection it may be of further advantage to construct the balloon or parachute itself to form a radar reflector. To this end the surface of the balloon or parachute may be covered with aluminum foil or the balloon may be filled with a chemical substance which itself functions as a radar reflector, for example, in the form of a well known, so-called gas lens. Such a gas lens is described in German patent application No. 1 506 139, published at June 12, 1969.

Figure 3:
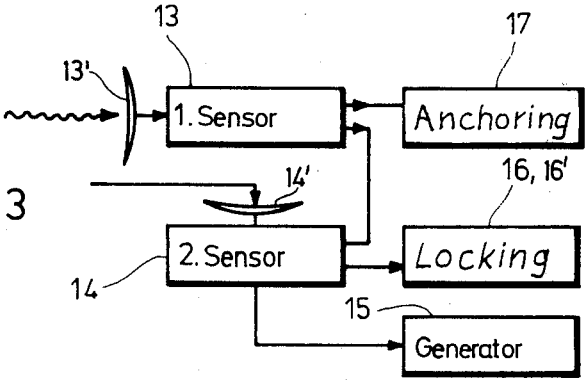
FIG. 3 is a block diagram showing the components of the present apparatus and their functional relationship to each other.

Referring to FIG. 3, the present system operates as follows. A signal picked up by the sonar sensor 13' while the buoy 12 is still under water activates the circuit arrangement of the first sensor means 13 to provide a signal to the anchoring means 17 for releasing or permitting the rise of the buoy 12 to the water level. Simultaneously the first sensor 13 also supplies an activating signal to the second sensor means which, upon reaching the water surface, will respond with its sensor 14', such as a pressure or light sensor to provide two signals one going to the locking means 16, 16' to open the buoy 12 by separating the two half shells 12*a* and 12*b*. The other signal from the second sensor 14 activates the gas generator 15 which may simply be the opening of a valve connecting a pressurized gas container to the balloon 11 for inflating the latter. Thus, the first sensor is coupled to the second sensor, for gating actuation by the second sensor as described above.

Incidentally, the gas supply generator 15 may be of any conventional type suitable for the intended purpose. Thus, for example, in the simplest embodiment a pressurized gas container may be connected through a valve to the balloon 11. With regard to the supply of electrical energy it is possible to use regular batteries or recharagable batteries. In connection with recharagable batteries it would be possible to provide for a recharging by means of solar cells or by means of any other energy gathering source, for example, a wind wheel driving an electric generator. Incidentally, rather than providing the inflation gas for the balloon from a pressurized container it is also possible to produce the gas by a chemical reaction as is well known in the art.

Although the invention has been described with reference to specific example embodiments, it will be appreciated, that it is intended to cover all modifications and equivalents within the scope of the appended claims.

What is claimed is:

1. A warning and signalling apparatus particularly for maritime use comprising: a first buoyancy element comprising collapsible balloon means; collapsible radar reflector means coupled to said balloon means; a second buoyancy element comprising buoy means, said buoy means comprising opening members and locking means coupling said opening members together to form a buoyant watertight compartment for housing said balloon means and radar reflector means; gas generating means also housed within said buoy means for inflating the collapsible balloon means; said buoy means further comprising anchoring means for retaining said buoy means on or below the surface of a water body, releasing means for releasing said buoy means and anchoring means, first underwater sensor means coupled to actuate said releasing means for releasing said buoy means sensing signals of predetermined character, second sensor means coupled to actuate said locking means for opening of the opening members of said buoy means at the surface of a water body upon release of said buoy means, said second sensor means being coupled to actuate said gas generator means for inflating said balloon means upon opening of the buoy means at the water surface, whereby said balloon means lifts the radar reflector means to a height over the water surface sufficient for radar detection after sensing of signals of said predetermined character.

2. The apparatus of claim 1, wherein said second buoyancy element further comprises a rocket having an adjustable flight ceiling.

3. The apparatus of claim 1, further comprising a lift element coupled in cooperative relationship with the first buoyancy element, said lift element comprising a storm kite.

4. The apparatus of claim 1, wherein said second buoyancy element further comprises marking means.

5. The apparatus of claim 1, wherein said radar reflector means comprise aluminum foils.

6. The apparatus of claim 1, wherein said radar reflector means comprise a chemical substance.

7. The apparatus of claim 1, wherein said radar reflector means comprise a plurality of elements connected to each other in a foldable manner, said elements being arranged for automatic unfolding by the first buoyancy element.

8. The apparatus of claim 1, wherein said collapsible radar reflecting means comprises a radar reflecting surface or coating formed over said first buoyancy element balloon means.

9. The apparatus of claim 1, further comprising transmitter means operatively arranged adjacent to the radar reflector means.

10. The apparatus of claim 1, wherein said first underwater sensor means is coupled to said second sensor means for gating actuation by said second sensor means.

* * * * *

UNITED STATES PATENT AND TRADEMARK OFFICE

CERTIFICATE OF CORRECTION

PATENT NO. : 4,281,427

DATED : August 4, 1981

INVENTOR(S) : Claus Petters

It is certified that error appears in the above-identified patent and that said Letters Patent is hereby corrected as shown below:

On the title page item [73] should read as follows:

--[73] Assignee: Messerschmitt-Boelkow-Blohm GmbH, Munich, Fed. Rep. of Germany--.

In the Claims:

Claim 1, line 16, after "buoy means" insert --upon--,

Signed and Sealed this

Twelfth Day of October 1982

[SEAL]

Attest:

GERALD J. MOSSINGHOFF

Attesting Officer

Commissioner of Patents and Trademarks